United States Patent [19]

Schär

[11] Patent Number: 4,796,495

[45] Date of Patent: Jan. 10, 1989

[54] MAGAZINE HAMMER

[75] Inventor: Anton Schär, Horgen, Switzerland

[73] Assignee: Hammermat AG, Zurich, Switzerland

[21] Appl. No.: 173,464

[22] Filed: Mar. 4, 1988

[30] Foreign Application Priority Data

Mar. 26, 1987 [CH] Switzerland ..... 842/87

[51] Int. Cl.[4] ..... B25G 1/00

[52] U.S. Cl. ..... 81/490; 81/20; 81/24; 227/114; 227/116; 227/117

[58] Field of Search ..... 81/20, 23, 24, 490; 227/113–117, 120

[56] References Cited

U.S. PATENT DOCUMENTS

| | | | |
|---|---|---|---|
| 516,593 | 3/1894 | Cushing | 227/113 |
| 599,741 | 3/1898 | Sauage | 81/24 |
| 840,441 | 1/1907 | Damonte | 227/113 |
| 4,340,101 | 7/1982 | Schar | 81/24 |
| 4,434,929 | 3/1984 | Keener | 81/23 X |

*Primary Examiner*—James G. Smith

*Attorney, Agent, or Firm*—Spensley Horn Jubas & Lubitz

[57] ABSTRACT

The magazine hammer has a hammer head (1) and a hammer shaft (2) running transversely to the latter. A guide channel (3) for guiding nails (4) from a nail magazine (5) runs in the longitudinal direction of the hammer shaft (2). The guide channel (3), in its end facing the hammer head (1), forms a deflection channel (7) for swinging round the nails (4) fed individually in their longitudinal direction. For this purpose, the deflection channel (7), on its lower side or its side remote from the hammer head (1), is provided with a passage slot (11) for the nail shank so that, in this area, a nail (4) fed individually in its longitudinal direction can swing about its nail head as a rotational axis into the desired setting position at the hammer head (1).

16 Claims, 3 Drawing Sheets

MAGAZINE HAMMER

BACKGROUND OF THE INVENTION

The invention relates to a magazine hammer having a hammer head, a hammer shaft running transversely to the latter, a guide channel running in the longitudinal direction of the hammer shaft and intended for guiding nails in its interior and in its longitudinal direction towards the hammer head, wherein a hollow space formed in the interior of the hammer shaft end remote from the hammer head, serving as a nail magazine and intended for accommodating a plurality of nails oriented in the longitudinal direction of the hammer shaft is arranged in front of this guide channel, having a deflection channel which is connected to the guide channel, opens out in the direct proximity of the hammer head and in which the nails moved individually towards the hammer head are deflected and moved into the dispensing position, having an apportioning device manually operable from outside and intended for individually delivering nails, originating from the nail magazine, in their longitudinal direction into he adjoining guide channel, and having a setting device which is arranged at the outlet end of the deflection channel and is designed to bring each nail coming out of the latter into an appropriate setting position relative to the hammer head.

A magazine hammer of the type mentioned at the beginning has already been disclosed by Swiss Patent specification No. 630.836. This known magazine hammer has the disadvantage that, with some people, in the case of certain nails, the delivery of individual nails from the nail magazine into the setting position provided at the hammer head sometimes causes difficulties.

SUMMARY OF THE INVENTION

The object of the present invention is primarily to create a magazine hammer of the type mentioned at the beginning which does not have the above stated disadvantage of this previously disclosed magazine hammer; that is, in which, the delivery of individual nails from the nail magazine into the setting position provided at the hammer head functions with difficulty for virtually all hammer users.

This object is achieved according to the invention in a magazine hammer of the type mentioned at the beginning when the deflection channel, on its side remote from the hammer head, and also at least one part joining this deflection channel, of the guide channel, on its underside, for swinging a nail, inserted individually into the guide channel in the longitudinal direction and with the nail head to the front, about its nail head and in a plane running through the hammer head and the hammer shaft into a position at least approximately parallel to the setting position, are provided with a continuous passage slot whose width, measured perpendicularly to the longitudinal axis of the guide channel, is less than the diameter of the nail head to be guided but at least slightly greater than the largest thickness of the nail shank to pass through, such that on the one hand the nail head is prevented from passing through the passage slot, but on the other hand the nail shank can swing out impeded.

At the same time, it is expedient if the deflection channel, as viewed in longitudinal section, over at least a part of its length, runs in a curve towards the hammer striking face.

However, it is also conceivable for the deflection and the guide channel to extend together at least approximately rectilinearly or in a shallow curve from the outlet side of the apportioning device towards the setting device provided at the hammer head.

To immediately stabilize the nail shank swinging out of the passage slot, as it moves into the setting position, it is expedient if an additional lateral nail-shank guide is allocated to the passage slot at least in the area of the deflection channel.

To loosen a bundle of nails inserted into the nail magazine, it is advantageous if the inner surface of the nail magazine is provided with projections which protrude into the nail magazine. In this case, the projections can also be formed by ribs.

Moreover, to separate the nails coming out of the nail magazine, it is expedient if at least two nail feed channels running next to one another and extending into the nail magazine are allocated to the apportioning device on its side facing the nail magazine, the passage cross-section of which nail feed channels is slightly larger than the nail-head end face of the largest nail head still to be let through, that the nail feed channels, on their outlet side, lead to a common nail guide channel part whose inlet cross-section has a width which is the same as or slightly greater than the diameter of the outlet cross-section of the influent nail feed channels and also a length which is the same as or slightly greater than the external dimension between the two outer nail feed channels, that the length of the nail guide channel part, measured in the longitudinal direction of the nail feed channels, is less than the shortest length of a nail to be let through, and that the apportioning device is arranged on the outlet side of the common nail guide channel part.

Moreover, it can be advantageous if the apportioning device has a nail release slide which is displaceable against a spring force acting on it and is provided with a nail passage opening which, when the nail release slide is displaced against the spring force acting on it, can be aligned with a first, fixed nail passage opening.

In order to shoot the individual nails into the setting position located at the hammer head, it is expedient if the apportioning device has an apportioning wheel which has at least three radially extending arresting and conveying teeth, movable one after the other into the nail guide channel, and which, when the apportioning device is actuated against spring means acting on this apportioning wheel, is turned abruptly by one tooth each time, that the rotational axis of the apportioning wheel runs perpendicularly to the longitudinal axis of the following nail guide channel, and that the individual teeth of the apportioning wheel, as viewed in the run-through direction of the nails to be conveyed, are made at least approximately U-shaped, the mutual spacing between the two legs of such a U-shaped tooth being less than the diameter of the smallest nail head to be gripped by it but greater than the diameter of the largest nail shank to be let through by it.

To separate the nails coming out of the nail magazine, it can also be advantageous if there is arranged between the nail magazine and the apportioning device a nail separating arrangement whose inlet part is formed by an at least approximately wedge-shaped receiving funnel whose inlet side is connected to the outlet side of the nail magazine and whose width is slightly greater than the outside diameter of the largest nail head still to be let through, that the outlet side of this receiving funnel leads into a nail-head guide channel which, in the working position of the hammer, runs down at a slope towards the passage opening of the apportioning device, and that provided between the nail-head guide channel and the receiving funnel is a nail-shank guide channel which is fully open towards these two parts and whose laterally open nail-shank inlet side has a width which is less than the diameter of the smallest nail-head still to be let through, but slightly greater than the diameter of the largest nail-shank still to be let through.

In addition, to obtain a simple means of refilling the nail magazine with nails it can be expedient if the nail magazine is designed to interchangeably accommodate a nail cartridge, the inner surface of the latter preferably being provided with projections protruding into the interior of the same.

BRIEF DESCRIPTION OF THE DRAWINGS

The invention is described in greater detail below by way of example with reference to the drawing, in which.

DESCRIPTION OF PREFERRED EMBODIMENTS

Figures 1, 1A, 2, 3, 4:
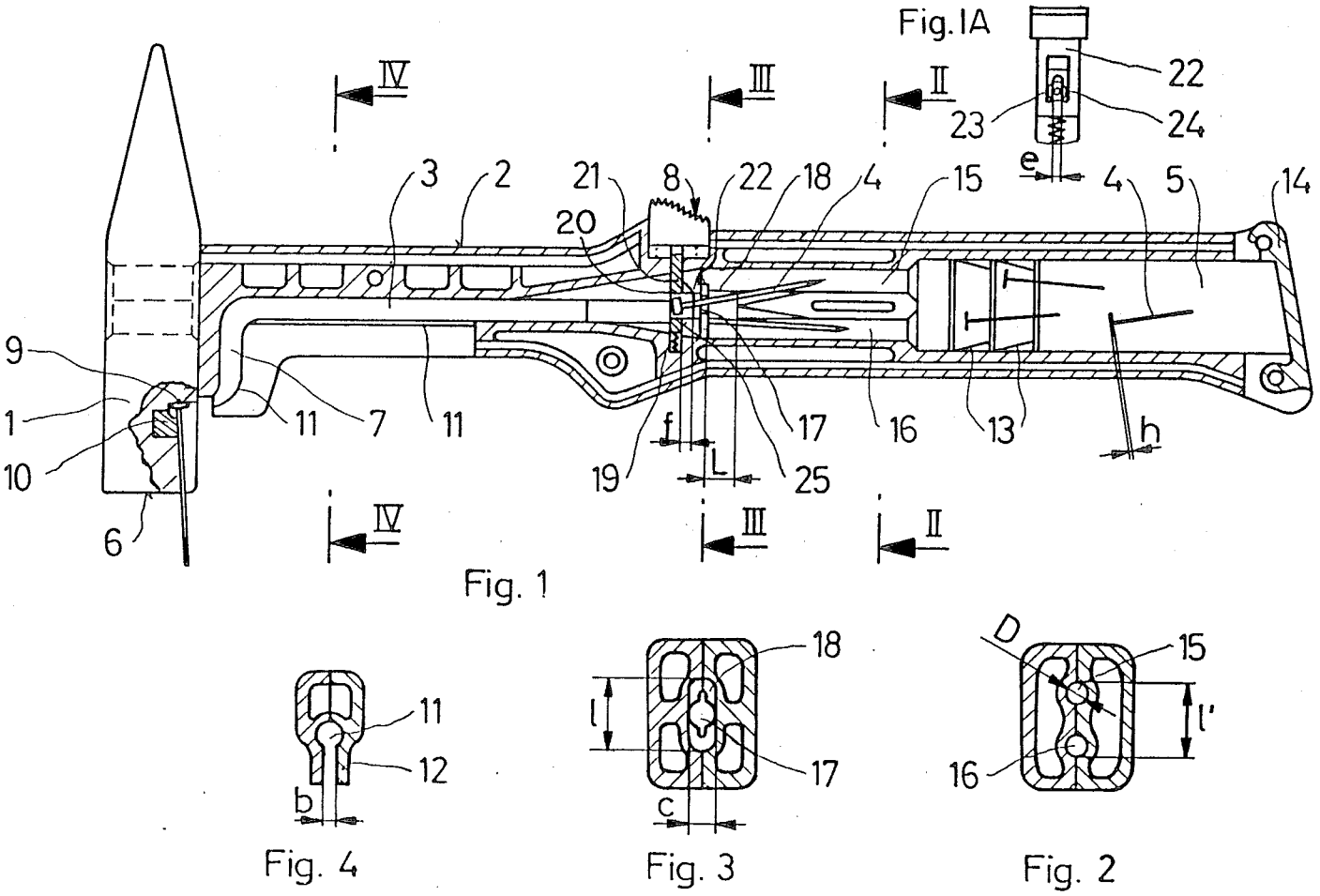
FIG. 1 shows a first exemplary embodiment of a magazine hammer according to the invention, partly shown in longitudinal section.
FIG. 1A depicts a fork-shaped cover part 22 having fork ends 23 and 24.
FIG. 2 shows a section along line II—II in FIG. 1.
FIG. 3 shows a section along line III—III in FIG. 1.
FIG. 4 shows a section along line IV—IV in FIG. 1.

As apparent from FIGS. 1 to 4, the magazine hammer shown by these figures has a hammer head 1, a hammer shaft 2 extending transversely to the latter, and also a guide channel 3 running in the longitudinal direction of the hammer shaft 2 and intended for guiding nails 4 in its interior and in its longitudinal direction towards the hammer head 1.

A hollow space 5 formed in the interior of the end of the hammer shaft 2 remote from the hammer head 1, serving as a nail magazine and intended to accommodate a plurality of nails 4 oriented in the longitudinal direction of the hammer shaft 2 is arranged in front of the guide channel 3.

Moreover, the hammer is provided with a deflection channel 7 which is connected to the guide channel 3, opens out in direct proximity of the hammer head 1, as viewed in the longitudinal section shown in FIG. 1 is curved downwards towards the hammer striking face 6 and in which the nails 4 moved individually towards the hammer head 1 are deflected from a horizontal into a vertical position and moved into the dispensing position.

An apportioning device 8, manually operable from outside, serves to deliver individual nails 4, originating from the nail magazine 5, in their longitudinal direction into the adjoining guide channel 3.

A setting device arranged at the outlet end of the deflection channel 7 is designed to bring each nail 4 coming out of the deflection channel 7 into an appropriate setting position relative to the hammer head 1. For this purpose, it has a nose 9, which is set back relative to the striking face 6 of the hammer head 1 in the aperture area of the deflection channel 7 running in a curve towards the setting device and is designed for inserting the nail 4 into its setting position, and also a permanent magnet 10 which is arranged and designed in such a way that it detachably and magnetically secures each nail 4 delivered from the deflection channel 7 in its setting position, with the nail head resting on the nose 9.

As apparent in particular from FIGS. 1 and 4, the deflection channel 7, on its side remote from the hammer head 1, and also at least one part, adjoining this deflection channel 7, of the guide channel 3, on its underside, for swinging a nail 4, inserted individually into the guide channel 3 in the longitudinal direction and with the nail head to the front, about its nail head as a rotational axis into a position at least approximately parallel to the setting position, are provided with a continuous passage slot 11 intended for the nail shank. To enable the nail shank which is to be swung to pass unimpeded through the passage slot 11 and also to enable a pivot to be formed about the head of the nail to be swung, in the guide channel 3, the width b (FIG. 4) of the passage slot 11, measured perpendicularly to the longitudinal axis of the guide channel 3, is less than the diameter of the nail head to be guided in the guide channel 3 but slightly greater than the largest thickness of the nail shank to be let through such that on the one hand the nail head is prevented from passing through the passage slot 11 but on the other hand the nail shank can swing out unimpeded.

In order to prevent the nail shank which is swinging out of the passage slot 11 from swinging out transversely to the longitudinal axis of the hammer shaft 2, which could make it more difficult to accurately position in the desired setting position the nail 4 coming out of the deflection channel 7, there is allocated to the passage slot 11 an additional lateral nail-shank guide 12 extending along the passage slot 11 and acting transversely to the longitudinal axis of the hammer shaft 2 on the nail shank as it swings out.

In order to loosen a bundle of nails when it is being inserted into the nail magazine 5, the inner surface of the nail magazine 5 is provided with projections 13 protruding into the interior of the nail magazine 5. These projections 13 can, for example, be formed in a rib or scale shape in such a way that on the one hand a bundle of nails is loosened when moved in the direction of the hammer head, but on the other hand an unimpeded movement of the nails in the direction of the magazine lid 14 is obtained when the hammer is lifted while working with the same.

In order to obtain trouble-free separation of the nails 4 coming out of the nail magazine 5, two nail feed channels 15 and 16 running next to one another and extending into the nail magazine 5 are allocated to the apportioning device 8 on its side facing the nail magazine 5. In this arrangement, the passage cross-section of the nail feed channels 15 and 16 is slightly larger than the nail-head end face of the largest nail head still to be let through.

So that the nails 4 coming out of the nail feed channels 15 and 16 can be fed to a single, common passage opening 17 of the apportioning device 8, the nail feed channels 15 and 16, on their outlet side, lead into a common nail guide channel part 18 whose inlet cross-section has a width c (FIG. 3) equal to the diameter D (FIG. 2) of the outlet cross-section of the influent nail feed channels 15 and 16 and also a length 1 which is the same as the external dimension 1' between the two outer nail feed channels 15 and 16. The length L (FIG. 1) of the nail guide channel part 18, measured in the longitudinal direction of the nail feed channels 15 and 16, is less than the shortest length of a nail 4 to be let through so as to ensure that the nails 4 coming out of the nail feed channels 15 and 16 are directed more precisely towards the first passage opening 17 of the apportioning device 8.

The apportioning device 8 serving to deliver individual nails 4 has a nail release slide 21 which is manually displaceable perpendicularly to the guide channel 3 against a compression spring 19 acting on it and is provided with a second nail passage opening 20 which, when the nail release slide 21 is displaced against the spring force acting on it, can be aligned with the first, fixed nail passage opening 17 so that an individual nail 4 can be released and can enter into the adjoining guide channel 3.

In order to reliably prevent a further nail 4 from accidentally being able to pass through the two passage openings 17 and 20 into the guide channel 3 as the nail release slide 21 is moved into the depressed discharge position, shown in FIG. 1, there is provided on the slide 21 a forkshaped cover part 22 which extends down over the passage opening 20 of the slide 21 and whose fork ends 23 and 24 are distanced (distance e) from one another to the extend that the nail shank of the first nail can pass through between them unimpeded but not the nail head of a subsequent nail (see enlarged detail C in FIG. 1). Moreover, the fork-shaped cover part 22 is distanced from the facing slide surface by a distance f which is slightly less than the thickness h of a nail head to be let through the second passage opening 20. In the upper inoperative position (not shown) of the slide 21, the fork-shaped cover part 22 and the second passage opening 20, as viewed in the longitudinal direction of the hammer shaft 2, are located above the first passage opening 17 so that, in this end position of the slide 21, a nail arriving from the nail guide channel part 18 with the nail head to the front can pass unimpeded through the first passage opening 17 until the nail head bears against the facing slide surface but not further. If the nail release slide 21 of the apportioning device 8 is now pressed down, the head of the nail 4 to be let through passes freely between the slide surface facing it and the fork-shaped cover part 22, the latter loosely surrounding the shank of the nail 4 to be let through so that the nail thus gripped, when its head is in alignment with the passage opening 20 of the slide 21, is delivered into the adjoining guide channel 3. Since in this lower end position (shown in FIG. 1) of the slide 21 the fork-shaped cover part 22 is located between the two passage openings 17 and 20 in alignment with one another, no further nail 4 can pass undesirably into the guide channel 3 in this position of the apportioning device 8.

Of course, the nail feed channels 15 and 16, instead of being arranged one above the other as shown, can also be arranged side by side.

Figure 5:
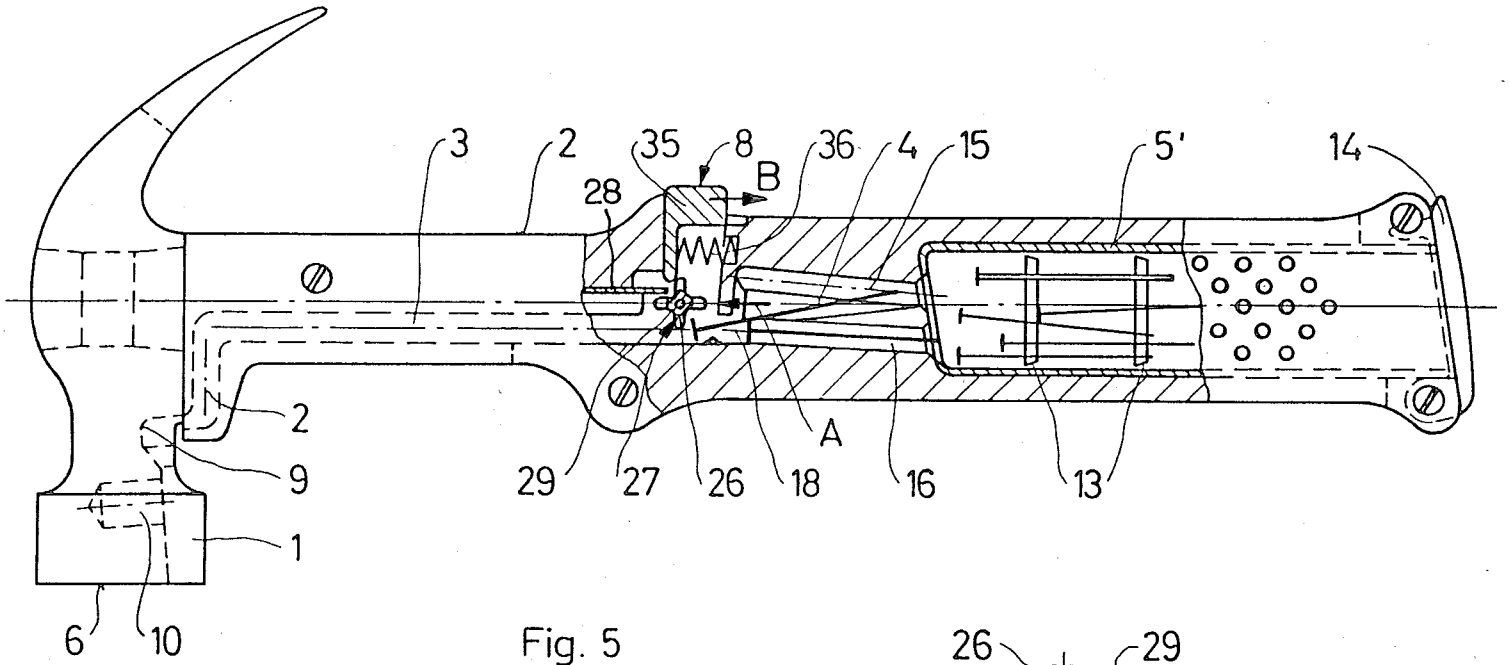
FIG. 5 shows a second exemplary embodiment of a magazine hammer according to the invention, partly shown in longitudinal section.
Figure 6:
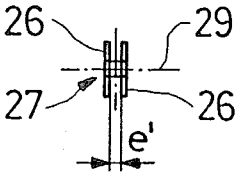
FIG. 6 shows, to an enlarged scale, a view of the apportioning wheel in the direction of arrow A drawn in FIG. 5.

In the second exemplary embodiment, shown by FIGS. 5 and 6, of a magazine hammer according to the invention, parts analogous to the first exemplary embodiment described in detail above are provided with the same reference numerals so that it is not necessary to describe these analogous parts again.

As apparent from FIGS. 5 and 6, the apportioning device 8 shown in this exemplary embodiment has an apportioning wheel 27 which has four radially extending arresting and conveying teeth 26, movable one after the other into the nail guide channel 3, and, when the operating knob 35 is displaced in the direction of arrow B, is turned further abruptly by one tooth 26 each time against the spring force of the compression spring 36 and of the leaf spring 28 acting on the apportioning wheel 27.

In this arrangement, the rotational axis 29 of the apportioning wheel 27 runs perpendicularly to the longitudinal axis of the following nail guide channel 2. So that the head, located in the apportioning device 8, of a nail 4 to be shot forward towards the hammer head 1 can be correctly gripped from the rear by a conveying tooth 26 following during abrupt rotation of the apportioning wheel, the individual teeth 26 of the apportioning wheel 27, as viewed in the run-through direction of the nails 4 to be conveyed, as apparent from FIG. 6, are made at least approximately U-shaped, the mutual spacing e' between the two legs of such a U-shaped tooth 26 being less than the diameter of the smallest nail head to be gripped by it, but greater than the diameter of the largest nail shank to be let through by it.

The nail magazine is designed to interchangeably accommodate a nail cartridge 5', the inner surface of the latter, for loosening the bundle of nails, being provided with ribs 13 protruding into the interior of the nail cartridge 5'.

Figure 7:
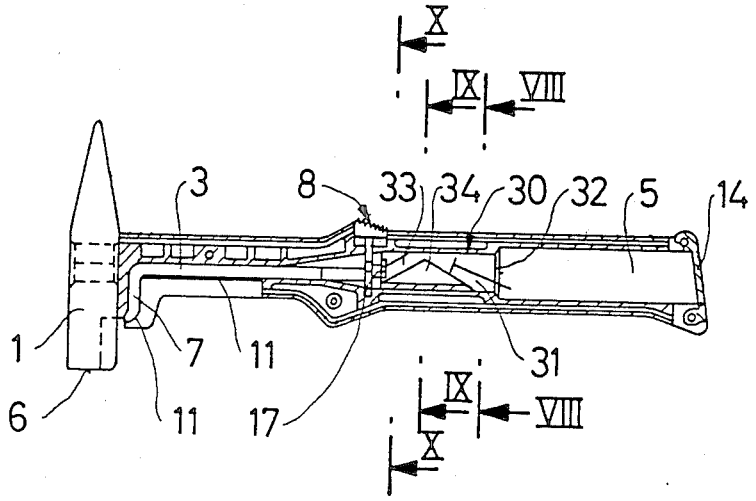
FIG. 7 shows a third exemplary embodiment of a magazine hammer according to the invention, partly shown in section.
Figure 8:
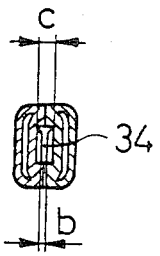
FIGS. 8,9 and 10 show sections along the section lines XIII—XIII, IX—IX and X—X respectively in FIG. 7.
Figure 9:
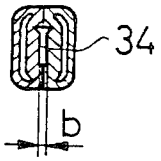
Figure 10:
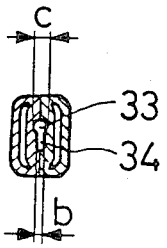

In the third exemplary embodiment, described below with reference to FIGS. 7 to 9, of a magazine hammer according to the invention, instead of the nail feed channels 15 and 16, there is arranged between the nail magazine 5 and the apportioning device 8 a nail separating arrangement 30 whose inlet part is formed by an at least approximately wedge-shaped receiving funnel 31 whose inlet side 32 is connected to the outlet side of the nail magazine 5. The width c of the receiving funnel 31, to guide the nail heads entering from the nail magazine 5, is slightly larger than the outside diameter of the largest nail head still to be let through.

The outlet side of the receiving funnel 31 leads into a nail-head guide channel 33 which, in the working position of the hammer, runs down at a slope towards the passage opening of the apportioning device. Provided between the nail-head guide channel 33 and the receiving funnel 31 is a nail-shank guide channel 34 (see FIG. 9) which is fully open towards these two parts 31 and 33 and whose laterally open nail-shank inlet side has a width b which is less than the diameter of the smallest nail head still to be let through by the apportioning device 8 but slightly greater than the diameter of the largest nail shank still to be admitted.

In this exemplary embodiment, the apportioning device 8 can, for example, be designed as in the magazine hammers already described above.

I claim:

1. A magazine hammer comprising:

a hammer head, a hammer shaft running substantially transversely to the hammer head, a guide channel running substantially in the longitudinal direction of the hammer shaft and having an interior configured to guide nails towards the hammer head, a nail magazine comprising a hollow space formed in the interior of the hammer shaft end remote from the hammer head for accommodating a plurality of nails substantially oriented in the longitudinal direction of the hammer shaft, an apportioning device for individually delivering nails originating from the nail magazine, in their longitudinal direction, into the guide channel, a deflection channel disposed substantially adjacent the hammer head and having an outlet end, in which the nails moved individually towards the hammer head are deflected and moved into a dispensing position, the deflection channel and the guide channel having a passage slot configured so that the nail head is prevented from passing through the passage slot and the nail shank is permitted to swing out unimpeded, and a setting device arranged at the outlet end of the deflection channel and configured to bring each nail coming out of the deflection channel into an appropriate setting position relative to the hammer head.

2. A device as in claim 1 wherein the passage slot is provided adjacent the deflection channel side remote from the hammer head and along at least a portion of the guide channel underside, the passage slot having a width which, measured perpendicularly to the guide channel longitudinal axis, is less than a predetermined nail head diameter but greater than a predetermined nail shank thickness, the passage slot being configured to enable a nail inserted in the guide channel with the nail head oriented toward the hammer head to be swung about the nail head in a plane running through the hammer head and the hammer shaft into a position approximately parallel to the setting position.

3. A device as in claim 1 wherein the hammer head includes a hammer striking face and at least a portion of the deflection channel is curved towards the hammer striking face.

4. A device as in claim 1 wherein the hammer head has a substantially longitudinal axis and at least a portion of the deflection channel is substantially parallel to the longitudinal axis of the hammer head.

5. A device as in claim 1 wherein at least a portion of the deflection channel defines a substantially S-shaped curve.

6. A device as in claim 2 further comprising a lateral nail-shank guide disposed substantially adjacent at least a portion of the passage slot.

7. A device as in claim 1 wherein the nail magazine comprises an inner surface provided with projections which protrude into the hollow space of the nail magazine.

8. A device as in claim 1 further comprising:

at least two nail feed channels extending substantially between the nail magazine and the apportioning device, the nail feed channels having a cross section larger than a predetermined largest nail-head diameter, and a common nail guide channel extending substantially between the nail feed channels and the apportioning device, the common nail guide channel having a length which, measured in the longitudinal direction of the nail feed channels, is less than a predetermined shortest nail length.

9. A device as in claim 1 further comprising:

a fixed nail passage adjacent the apportioning device, a nail release slide associated with the apportioning device and having a nail passage opening therein; and means for displacing the nail release slide relative to the fixed nail passage to thereby aligned the nail passage opening of the nail release slide and the fixed nail passage.

10. A device as in claim 1 wherein the apportioning device comprises:

an apportioning wheel having a plurality of radially extending arresting and conveying teeth and being centered about a rotational axis which is substantially perpendicularly to the longitudinal axis of the nail guide channel, and means for turning the apportioning wheel about the rotational axis by one tooth at a time, whereby nails are movable one after the other into the nail guide channel.

11. A device as in claim 10 wherein at least one of the teeth of the apportioning wheel has two legs and is substantially U-shaped, the distance between the two legs being less than a predetermined smallest nail head diameter to be gripped by the tooth but greater than a predetermined largest nail shank diameter to be let through by the tooth.

12. A device as in claim 1 further comprising:

a nail separating means arranged between the nail magazine and the apportioning device, the nail separating means including:

a substantially wedge-shaped receiving funnel adjacent the nail magazine, the receiving funnel having a width greater than a predetermined largest nail head diameter to be let through, a nail-head guide channel sloped towards the apportioning device, and a nail-shank guide channel provided between the nail-head guide channel and the receiving funnel, the nail-shank guide channel including an inlet having a width which is less than a predetermined smallest nail-head diameter but greater than a predetermined largest nail-shank diameter.

13. A device as in claim 1, wherein the nail magazine is configured to accommodate a nail cartridge provided with projections protruding into the interior of the nail cartridge.

14. A device as in claim 1 wherein the setting device comprises a permanent magnet fixed to the hammer head and arranged to detachably and magnetically secure each nail delivered from the deflection channel in the setting position.

15. A device as in claim 1 wherein the hammer head further comprises:

a striking face, and a nose provided adjacent the deflection channel and set back relative to the striking face, the nose being configured to receive the nail in its setting position.

16. A device as in claim 9 wherein the nail release slide is provided with a fork-shaped cover part extending over at least a portion of the nail passage opening of the nail release slide, the fork-shaped cover part having two fork ends spaced apart by a distance which is greater than a predetermined nail-shank diameter but less than a predetermined nail-head diameter, and the fork-shaped cover part being spaced from the surface of the nail release slide by a distance which is greater than a predetermined nail-head thickness.

* * * * *